US009764248B2

(12) United States Patent
Schwalm, Jr.

(10) Patent No.: US 9,764,248 B2
(45) Date of Patent: Sep. 19, 2017

(54) PRESSURE CONTAINED CAR CANNON

(71) Applicant: James Doyle Schwalm, Jr., Hermosa Beach, CA (US)

(72) Inventor: James Doyle Schwalm, Jr., Hermosa Beach, CA (US)

( * ) Notice: Subject to any disclaimer, the term of this patent is extended or adjusted under 35 U.S.C. 154(b) by 0 days.

(21) Appl. No.: 15/178,213

(22) Filed: Jun. 9, 2016

(65) Prior Publication Data

US 2016/0361665 A1 Dec. 15, 2016

Related U.S. Application Data

(60) Provisional application No. 62/174,112, filed on Jun. 11, 2015.

(51) Int. Cl.

| | |
|---|---|
| ***B60S 9/10*** | (2006.01) |
| ***A63J 5/00*** | (2006.01) |
| ***A63H 17/00*** | (2006.01) |

(52) U.S. Cl.
CPC ..... *A63J 5/00* (2013.01); *A63H 17/004* (2013.01)

(58) Field of Classification Search
CPC ..... B60S 9/00; B60S 9/10; B60S 9/21; B60S 11/00; B60S 13/00; A63J 5/00; A63H 17/004
See application file for complete search history.

(56) References Cited

U.S. PATENT DOCUMENTS

2007/0259601 A1* 11/2007 Dunham ..... A63H 17/004 446/466

* cited by examiner

*Primary Examiner* — Larry E Waggle, Jr.
*Assistant Examiner* — Nirvana Deonauth
(74) *Attorney, Agent, or Firm* — Sanford Astor

(57) ABSTRACT

A pressure contained car cannon for the launching and/or flipping of vehicles, or other large-scale props, for use in motion picture action sequences. The device consists of a car canon having a barrel, a cannon foot and a piston. By way of pneumatic pressure, force is achieved by transferring energy from the piston to the cannon foot, resulting in a push force which expels the cannon foot from the cannon barrel, launching the vehicle on its desired trajectory while keeping most all vapor and smoke contained within the barrel itself.

19 Claims, 8 Drawing Sheets

PRESSURE CONTAINED CAR CANNON

CROSS-REFERENCE TO RELATED APPLICATIONS

This application claims the benefit of U.S. provisional application Ser. No. 62/174,112 filed Jun. 11, 2015, the disclosure(s) of which is hereby incorporated in its entirety by reference herein.

TECHNICAL FIELD

This invention relates to the process of filming cinematic sequences wherein live action vehicles or other large-scale props, are forcibly overturned for the camera.

BACKGROUND

These stunts often require the demonstration of large props, such as cars, SUV's, other vehicles, or other large scale props, traveling at high speeds, traveling through the air and flipping over.

Techniques for achieving cinematic special effects such as overturning a vehicle have been limited over the years. For instance, the most widely used method for inverting a vehicle, known as the black powder method, dates back to the early days of movie making. Its primitive technique can achieve positive results, however, it also carries several variables relating to both safety and effectiveness.

The black powder method involves attaching a cannon to the object or vehicle being overturned, placing a certain amount of black powder inside the cannon, and finally inserting a wooden or metal rod into the cannon. Once ignited, the powder emits a small explosion inside the cannon. The force created by this explosion expels the rod out of the cannon into the ground, and the resulting push force from the rod flips or overturns the vehicle.

Depending on the desired course of the vehicle and height of the flip, the amount of powder needed to accomplish the effect fluctuates; however, there is no definitive equation in which to determine the exact amount of force that will be generated from the amount of black powder used. Methods are indecisive at best, as it has remained over the years mostly a guessing game. These variables pose several threats to the overall success of the effect, including a significant safety risk to the crew, but especially to the stunt driver.

Another significant component in the black powder method is the use of wooden posts as the rod. Once detonated, the rod is expelled from the cannon shaft with unpredictable force. This is generally known as "the spit wad effect". It is this force that ultimately launches the vehicle, however its unpredictable nature imposes a real safety threat for both crew and drivers. It is impossible to predict the course of the rod once it is ejected from the cannon shaft, and its resulting impact with the ground will often times cause a wooden rod to shatter, creating dangerous splinters which can injure those nearby.

Furthermore, the explosion itself causes an excessive amount of smoke and other fumes which manifest into a large cloud that trails the vehicle. It is then necessary to remove this cloud of smoke in post-production with the use of a computer, leaving a costly burden for the production.

No system currently exists which creates the desired effect of overturning a vehicle, or similarly large object, while not only maintaining a safe environment on set, but also with foreseeable accuracy.

SUMMARY OF THE INVENTION

The invention comprises a device created for the flipping or overturning of vehicles, or other large props, both stationary and in motion, for use in motion picture action sequences. The pressure contained car cannon of this invention consists of three major components, the cannon barrel, the cannon foot, and the piston. By way of pneumatic pressure, force is achieved by the transferring of energy from the piston to the cannon foot. The resulting push force expels the foot from the cannon barrel, thus launching the vehicle on its desired trajectory, while still keeping all vapor and smoke contained within the barrel itself.

The pressure contained car cannon is a self-contained system. It uses compressed gasses such as compressed air or other gasses, preferably nitrogen, as the source of its power, which is not only an effective propellant, but also allows the system to be pre-charged with accuracy up to +/−1 psi. The ability to pre-charge the compressed air or nitrogen allows an operator to know the exact amount of push force the cannon foot will inflict against the road, based on the psi charged in gas tanks prior to the effect.

The system also allows for operators to control the speed at which the air or nitrogen enters the cannon during implementation by use of a high pressure ball valve, thus adjusting the height and speed of the effect with great accuracy. For example, decreasing the speed of entry of the gas into the cannon will produce a slower car roll, whereas increasing the speed of gas entry can result in a car flip of extreme altitudes.

Furthermore, the resulting shock impact from detonation is greatly reduced by the use of compressed air or nitrogen. When using a black powder cannon, it may take less than 1/30 of a second to detonate, creating potential harm to drivers based on the resulting G force. In some cases drivers were even known for blacking out during detonation. However, the pressure controlled car cannons take more than ½ of a second to propel, significantly reducing the G force impact placed on the driver and creating a much safer environment overall.

Because the system is self-contained, no pressure or gas is lost during implementation. This gives the operators the added benefit of being able to analyze the effect after it has been completed.

This system also eliminates what is known as "the spit wad effect", meaning the foot is not expelled with excessive velocity from the cannon. By leaving the piston inside the cannon barrel, the cannon foot itself does not turn into a projectile. The nitrogen or compressed air is kept behind the piston, by seals behind the piston, and never makes contact with the cannon foot, giving it significantly less energy once the piston has stopped moving and creating a much safer environment for crew members.

The piston also acts as a barrier for any gas or vapor that may be a by-product of the effect, thus eliminating the contrail previously produced during this effect and its need to be removed in post-production.

Every component within the pressure contained car cannon can be pre-checked and certified prior to implementation. Moreover, the entire system is entirely reusable, making it a very cost effective device.

DETAILED DESCRIPTION

Figure 1:
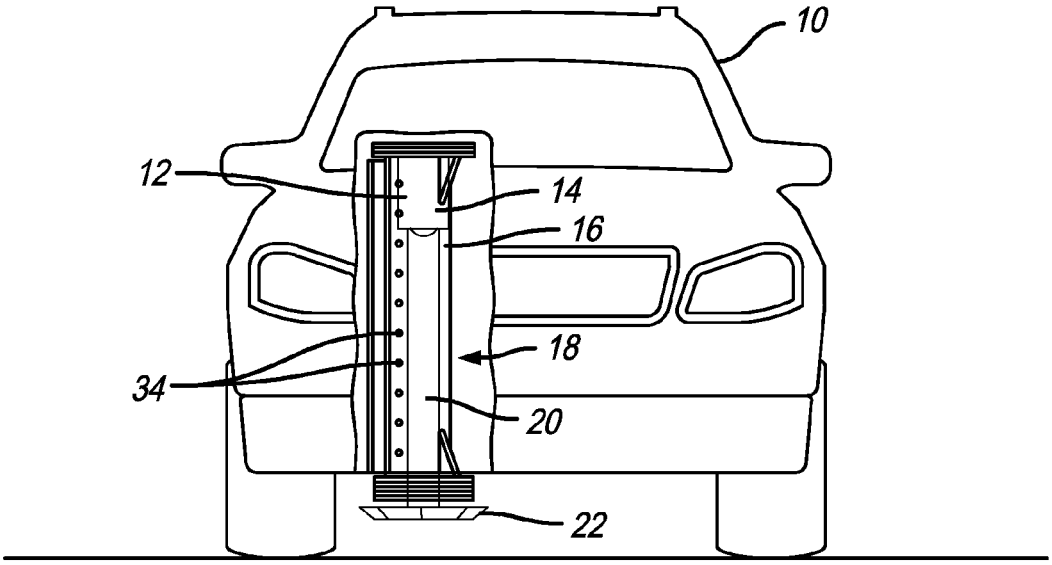
FIG. 1 is a front view drawing of a vehicle containing a pressure contained car cannon of this invention.

The drawings referring to FIGS. 1-9 illustrate the details of the invention.

FIGS. 1-4 show the front of a vehicle 10 sitting on the ground and containing the pressure contained car cannon 12, comprising a piston 14, a barrel 16 and a canon foot 18. Car cannon 12 is located inside of the vehicle and FIGS. 1-4 show an opening in the front of vehicle 10 in order to see car cannon 12 in the American passenger seat area. Cannon foot 18 comprises a rod 20 and a foot 22.

Figure 7:
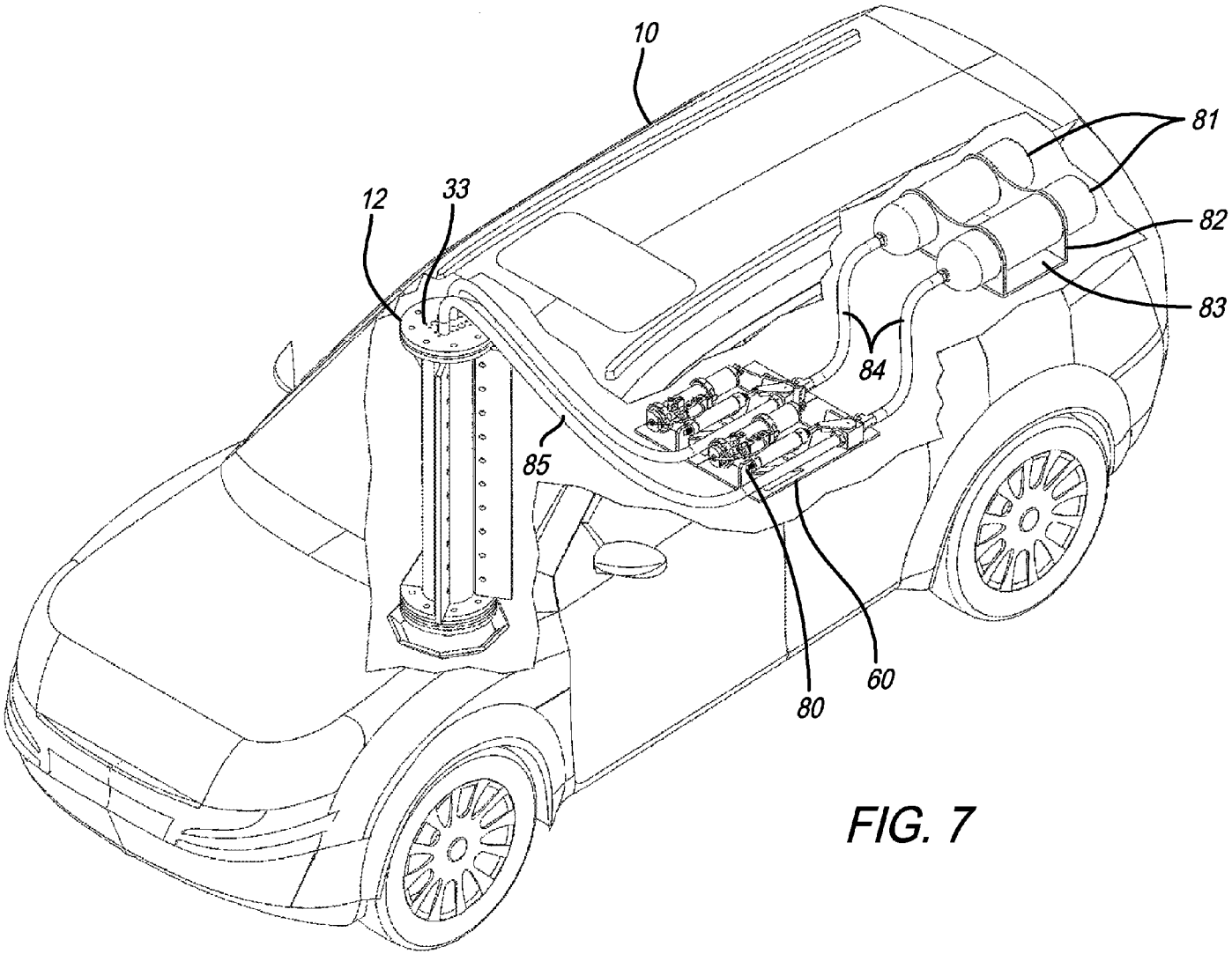
FIG. 7 is a perspective view of the vehicle with a portion of the top of the vehicle removed.

The gas to be used for the effect or stunt, such as air or nitrogen, is contained in one or more gas tanks, which are placed into vehicle 10 where they cannot be seen. The gas tanks are shown in FIG. 7. The location of the gas tanks will vary depending upon the specific needs and/or dimensions of the vehicle being used. The tanks can be modified to fit in any location in the vehicle, such as the trunk, a passenger seat, rear seat, or if necessary a seat can be removed to make space for the tanks and/or car cannon 12. Air, nitrogen and other gasses may be used to activate the car cannon. Nitrogen is preferred and safer to compress, because it contains no oxygen.

Referring to FIG. 7, once a location for the high pressure gas tanks 81 has been determined, shown in the rear area, a high pressure tank plate 83 having clamps 82 is securely fastened, such as welding, into the location and tanks 81 are securely held by clamps 82. Also a valve mounting plate 60 is also securely fastened, such as welding, into a location in the vehicle. Valve mounting plate 60 contains the valve system 80, shown in FIGS. 8 and 9 in detail.

Figure 8:
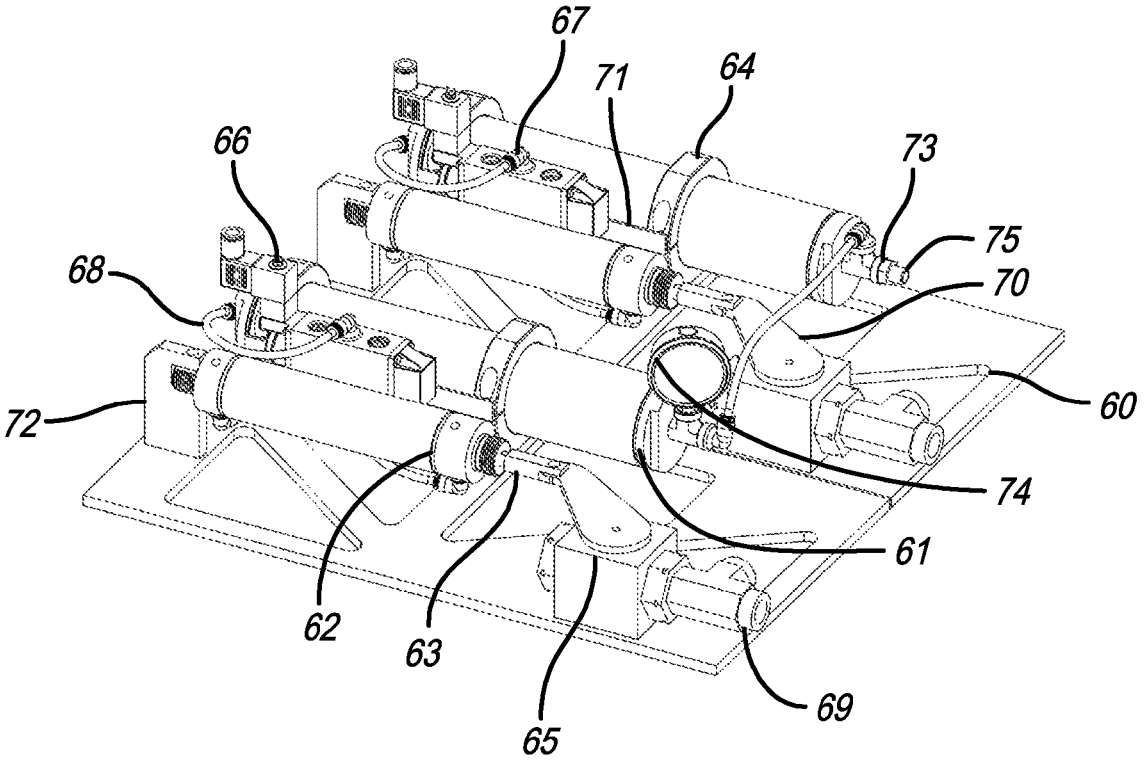
FIG. 8 is a perspective view of the valve assembly.
Figure 9:
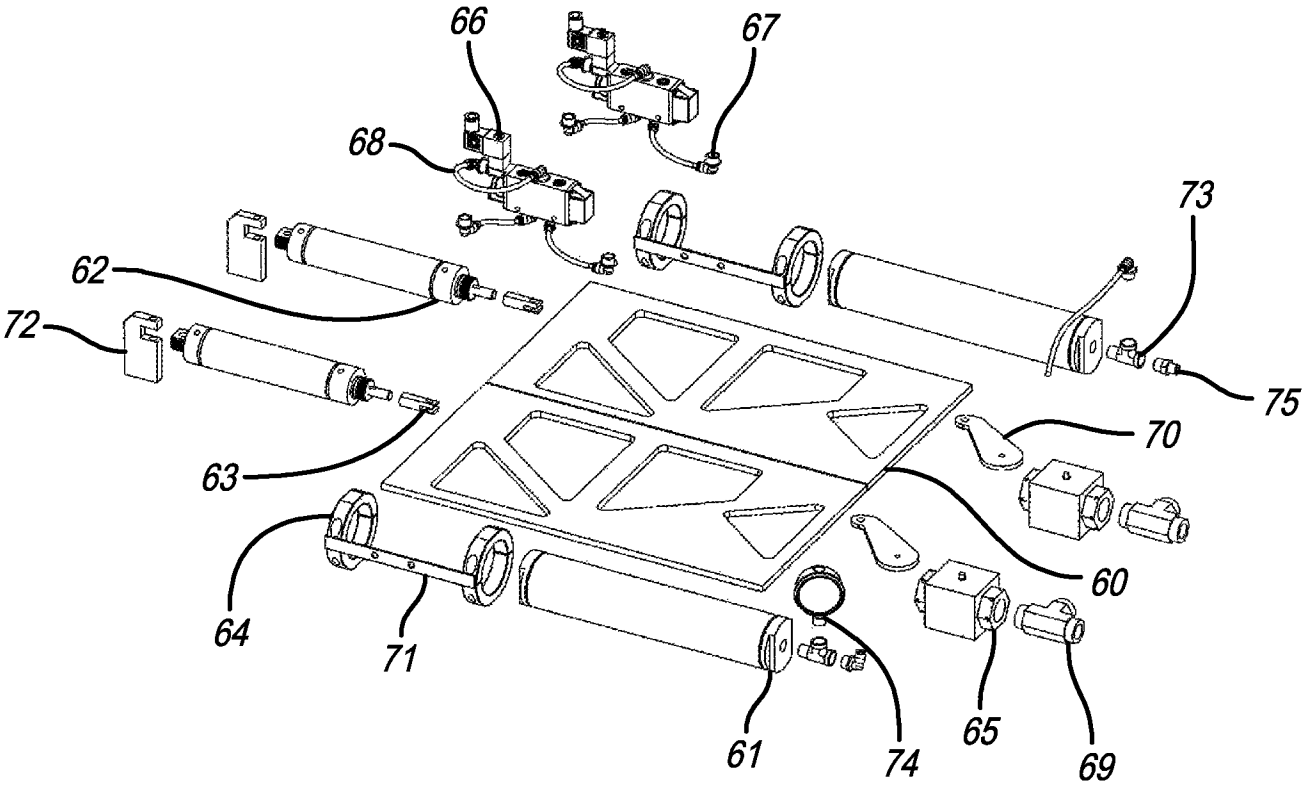
FIG. 9 is an exploded view of the valve assembly.

Referring to FIGS. 8 and 9, a 12-volt battery is used by the driver to activate a low pressure air control valve 66 which actuates a linear air cylinder. Low pressure air fitting 67 connects air lines to various components. Air line 68 is flexible tubing for connecting low pressure components. High pressure air fitting (t-valve) 69 connects high pressure air lines (not shown here) to high pressure ball valve 65. High pressure ball valve 65 provides high pressure for actuating cannon 12.

Ball valve linkage arm 70 converts linear motion from linear air cylinder 66 to rotational motion to open high pressure valve 65. Control valve 66 opens and allows gas from low pressure compressed air tanks 61 to travel into linear air cylinders 62. These air cylinders 62 then open high pressure ball valve 65 that allow gas from the high pressure compressed air tanks 81 to flow into cannon 12. High pressure lines 85 are attached to the top plate 33 of cannon 12 by flange mount fittings and the high pressure gas is released via the air actuated high pressure ball valve 65. The gas pressure used may be from 200 psi to 3000 psi as needed for the effect or stunt. Bottom plate 35 of cannon 12 has a center hole to receive rod 20.

The amount of gas and gas pressure sent to cannon barrel 16 for the stunt, is pre-determined by a special effects operator. The detonation of the high gas pressure to car cannon 12 is activated by the stunt driver who has a button or switch to activate a 12-volt battery. The stunt driver activates the gas detonation because the driver has to determine that all elements, such as speed and location, are in proper position. Detonation is accomplished by releasing the high pressure gas to power piston 14, strongly pushing rod 20 down and foot 22 down out of barrel 16. Power piston 14 remains in barrel 16.

Car cannon 12 can be attached anywhere in a vehicle. Placement is based on the desired trajectory of the vehicle. For instance, if cannon 12 is placed in the rear of a vehicle, when detonated, it will cause the vehicle to flip forwards, back end leading up. If placed in the front of a vehicle, when detonated, the vehicle will flip backwards, front end leading up. If placed on either side of the vehicle, the vehicle will flip sideways to right or left side of the vehicle. Cannon 12 is attached to the inside of the vehicle 12. It is welded to the existing vehicle chassis or roll cage. Steel roll cages are standard in most stunt vehicles.

Figure 2:
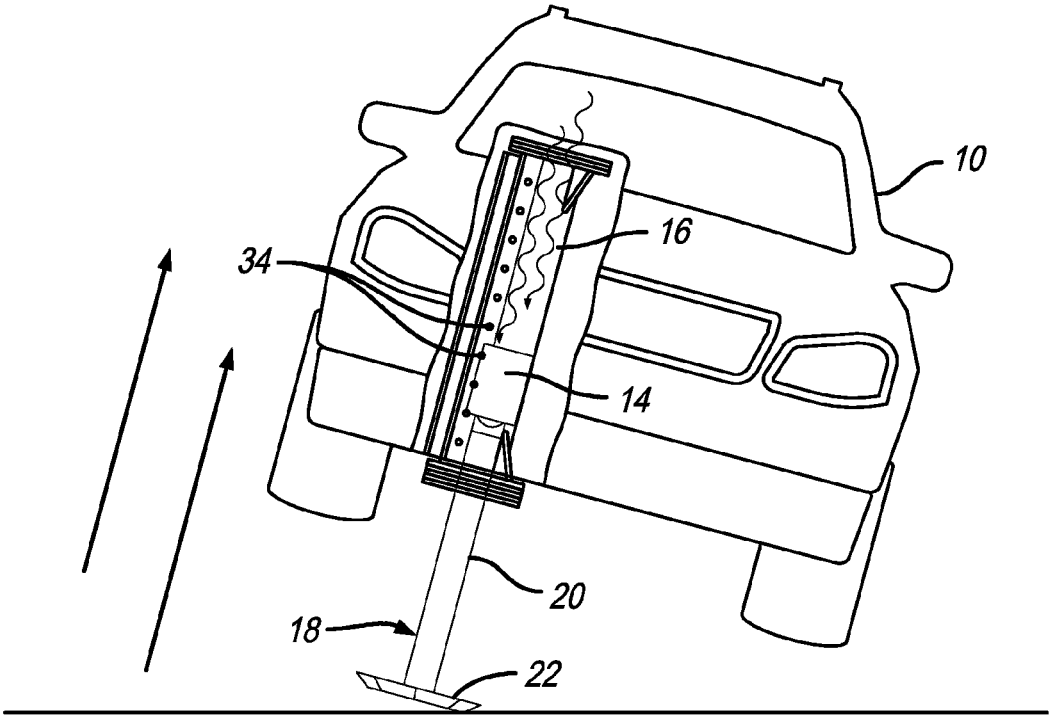
FIG. 2 is a front view of the vehicle with the cannon foot expelled.

FIG. 2 shows vehicle 10 leaving the ground and beginning to flip, after piston 14 transfers energy, by the high pressure compressed gas, such as nitrogen or air, as a propellant, from the piston 14 to the cannon foot 22, which has been expelled from barrel 16 and is hitting the ground and beginning to flip vehicle 10. Rod 20 has foot 22 at the bottom end of rod 20. Foot 22, being attached to rod 20 by steel bolts, is inserted into barrel 16 and rod 20 makes contact against the bottom of piston 14 but is not attached to it. The bottom of rod 20 is attached to circular foot 22, by steel bolts 32. Foot 22 is held in place at its base with a small piece of bailing wire (not shown). The wire attaches under the base of foot 22 and connects to the base plate 35 of the cannon 12. Upon detonation the wire naturally snaps and is discarded, it does not affect the car flip nor the expulsion of foot 22 from cannon 12. It is just strong enough to hold foot 22 in place long enough to be detonated.

Figure 3:
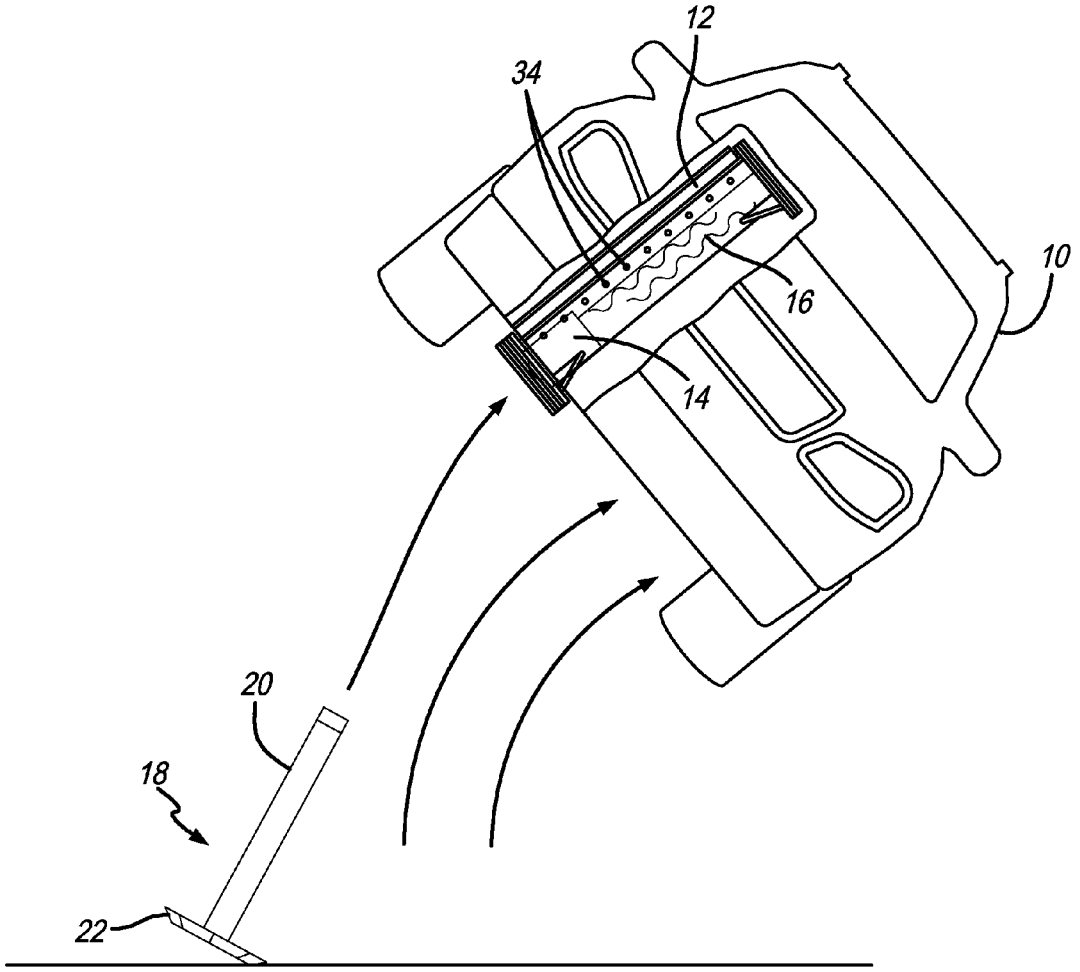
FIG. 3 is a front view of the vehicle launched into the air.

FIG. 3 shows vehicle 10 forced into the air with cannon foot 22 falling away from vehicle 10 and falling to the ground, while any remaining gas is left in barrel 16 behind piston 14 which remains in the bottom of barrel 16.

Figure 4:
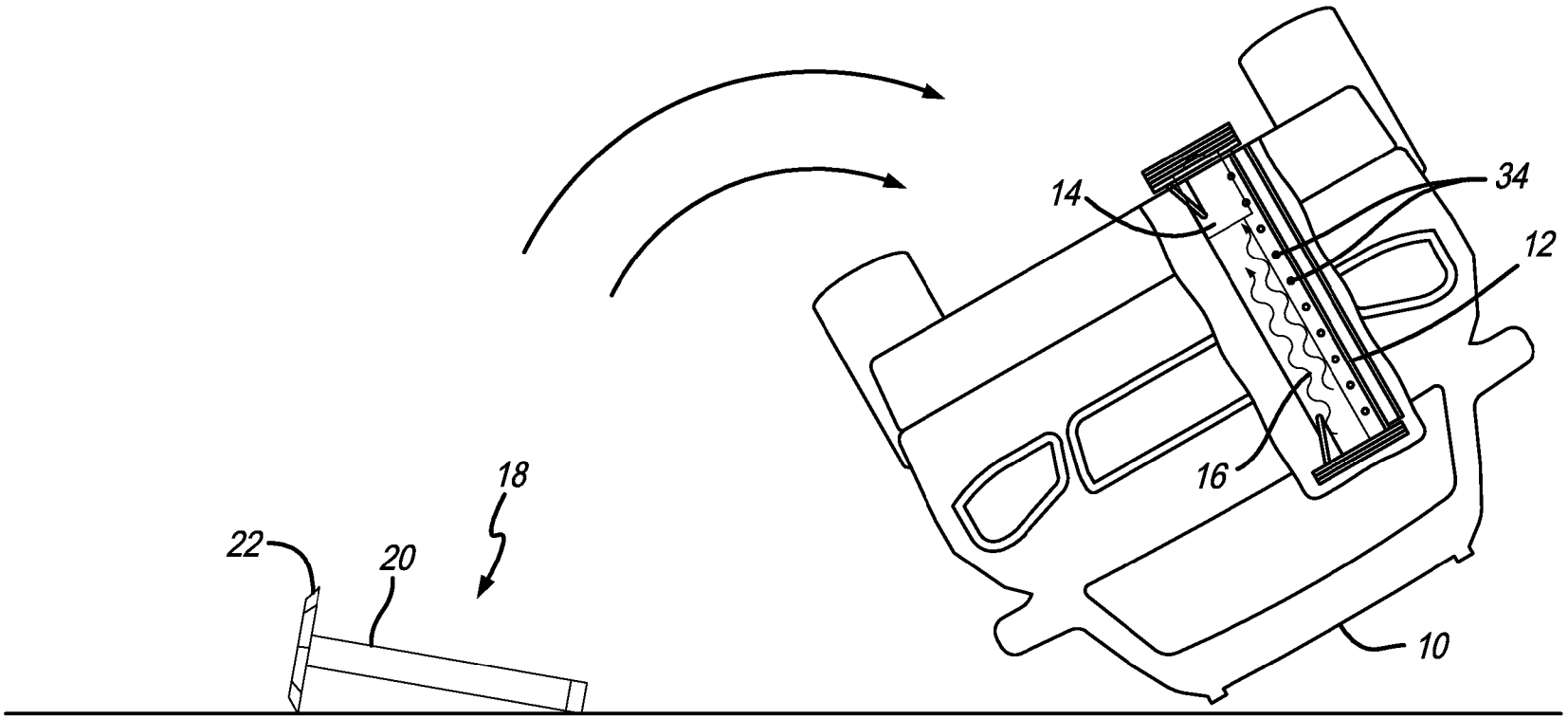
FIG. 4 is a front view of the vehicle about to land on its top.

FIG. 4 shows vehicle 10 about to land on its top with cannon foot 22 lying on the ground and the remaining gas in cannon barrel 16 behind piston 14.

Figure 5:
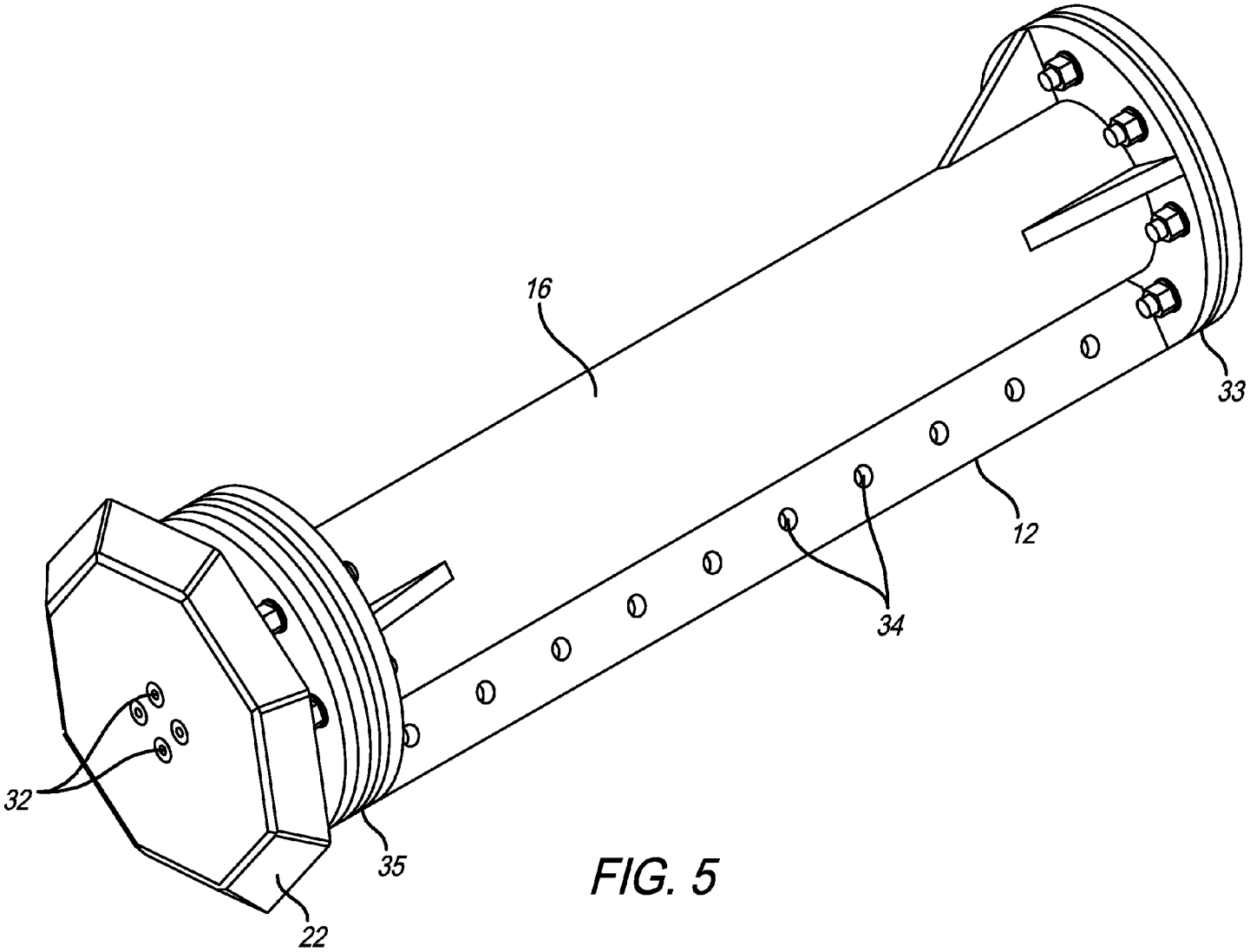
FIG. 5 is a perspective view of the pressure contained car cannon.

FIG. 5 is a perspective view of the closed pressure contained car cannon 12, showing cannon barrel 16 and cannon foot 22 attached to rod 20 by bolts 32 and the top flange 33 and bottom flange 35. Multiple holes 34 are used with wires or bolts to attach car cannon 12 to a vehicle.

Figure 6:
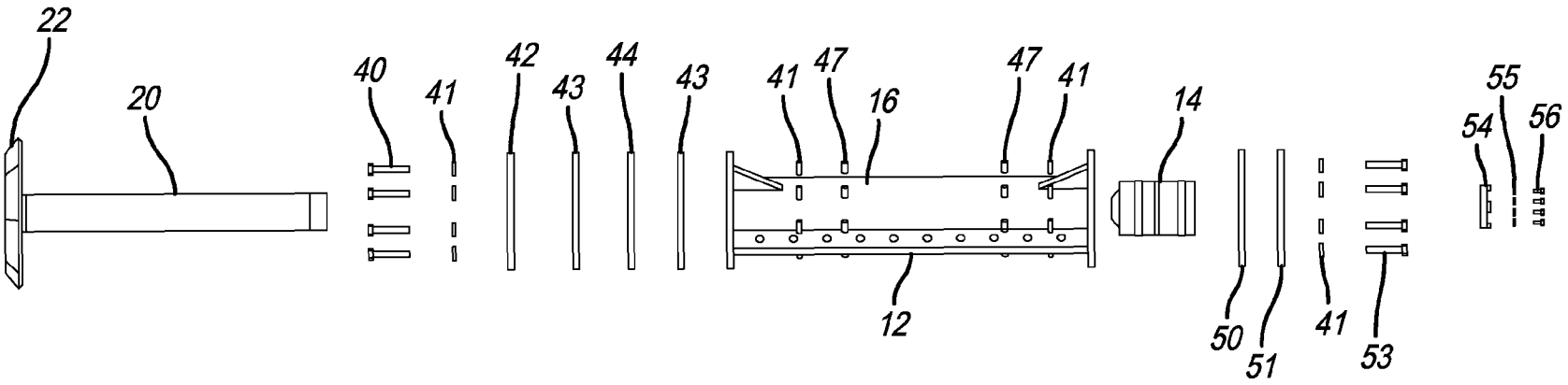
FIG. 6 is an exploded view of the pressure contained car cannon.

FIG. 6 shows the various parts of car cannon 12. The chart below itemizes each numbered part of the car cannon, their part description and their part function.

| PART NO. | PART DESCRIPTION | PART FUNCTION |
|---|---|---|
| 16 | BARREL - WELDED ASSEMBLY | ACTS AS CYLINDER BORE. HOLDS IN AIR, ALLOWS PISTON TO TRAVEL THROUGH. |

-continued

| PART NO. | PART DESCRIPTION | PART FUNCTION |
|---|---|---|
| 20/22 | CANNON FOOT | ELEMENT WHICH COMES IN CONTACT WITH THE GROUND. |
| 14 | PISTON | TRANSFERS ENERGY TO CANNON FOOT. PREVENTS GASSES FROM ESCAPING BARREL POST DETONATION. |
| 51 | INLET STEEL BULKHEAD | PORT OF ENTRY FOR COMPRESSED GASSES. |
| 50 | ALUMINUM GASKET PLATE | ACTS AS A BARRIER OR SEAL WHICH PREVENTS GASSES, FROM ESCAPING THE BARREL. |
| 42 | ROD STEEL RING | STOPS PISTON/PREVENTS PISTON FROM ESCAPING THE BARREL WHEN IT HITS THE END OF IT'S STROKE. |
| 44 | ROD DELRIN RING | ACTS AS SHOCK ABSORBER FOR PISTON |
| 43 | ROD RUBBER SEAL | ACTS AS SHOCK ABSORBER FOR PISTON |
| 53 | ¾"-10 × 3" GRADE 8 HEX BOLT | SECURES THE INLET STEEL BULKHEAD |
| 40 | ¾"-10 × 4" GRADE 8 HEX BOLT | SECURES VARIOUS COMPONENTS. |
| 56 | ⅜"-16 × 1-¼" GRADE 8 HEX BOLT | SECURES HOSE FITTINGS WHICH ATTACH TO GAS LINES AND GAS TANKS. |
| 49 | ¾" FLAT WASHER | HELPS TO SPREAD BOLT LOAD, ALLOWS FOR MORE SECURITY. |
| 47 | ¾"-10 GRADE 8 HEX NUT | SECURES BOLTS. |
| 54 | SPLIT FLANGE | ACTS AS CLAMP WHICH HOLDS GAS FITTINGS IN PLACE. |
| 55 | 318" SPLIT LOCK WASHERS | PREVENTS BOLTS FROM LOOSENING. |

FIG. 7 shows vehicle 10 with part of its top removed in order to see car cannon 12 and gas tanks 81. The high pressure gas tanks 81 are shown in the rear area, a high pressure tank plate 83 having clamps 82 is securely fastened, such as welding, into the vehicle and tanks 81 are securely held by clamps 82. Also a valve mounting plate 60 is also securely fastened, such as welding, into a location in the vehicle. Valve mounting plate 60 contains valve system 80, shown in FIGS. 8 and 9 in detail.

FIGS. 8 and 9 show the various parts of the valve assembly 80. The chart below itemizes each numbered part, their description and their part function. A description of the valve operation has been described in detail above.

This system for special effects prevents the escaping of gas/vapor and is also safer than other used systems. That is because the cannon foot is not ejected with excessive velocity from the cannon barrel. Other known systems continue exerting force on the ejected object, even after the vehicle has been flipped/launched. This can cause the ejected object to become a dangerous projectile and pose potential threats to crew members. This car cannon system prevents that by restricting the left over force in the barrel with the piston, so that the force is securely contained inside the cannon barrel.

As required, detailed embodiments of the present invention are disclosed herein; however, it is to be understood that

| No. | PART | DESCRIPTION |
|---|---|---|
| 60 | Valve Mounting Plate | Provides a rigid base for all of the components in the Valve Assembly |
| 61 | Low Pressure Compressed Air Tank | Provides low pressure to Low Pressure Air Control Valve |
| 62 | Linear Air Cylinder | Opens High Pressure Ball Valve |
| 63 | Cylinder Rod Clevis | Connects rod of Linear Cylinder to Ball Valve Linkage Arm |
| 64 | Air Tank Clamp | Fastens Low Pressure Air Tank to Mounting Plate |
| 65 | High Pressure Ball Valve | Provides high pressure for actuating Cannon |
| 66 | Low Pressure Air Control Valve | Actuates Linear air Cylinder when 12VDC is applied |
| 67 | Low Pressure Air Fitting (90°) | Connects Air Lines to various components |
| 68 | Air Line | Flexible tubing for connecting low pressure components |
| 69 | High Pressure air Fitting | Connects High Pressure Air Lines (not shown here) to High Pressure Ball Valve |
| 70 | Ball Valve Linkage Arm | Converts linear motion from Linear Air Cylinder to rotational motion to open High Pressure Ball Valve |
| 71 | Low Pressure Air Control Valve Mount | Fastens Low Pressure Air Control Valve to Air Tank Clamp |
| 72 | Linear Air Cylinder Pivot Plate | Fastens Linear air Cylinder to Valve Mounting Plate and allows for slight rotation of Linear Air Cylinder |
| 73 | Low Pressure Air Fitting | Connects Air Lines to various components |
| 74 | Pressure Gauge | Allows for monitoring of pressure inside Low Pressure Compressed Air Tanks |
| 75 | Low Pressure Air Fitting (Reducer) | Connects Air Lines to various components |

the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

What is claimed is:

1. A method for achieving a cinematic special effect of overturning a vehicle or large prop comprising: attaching a cannon into a vehicle or large prop; the cannon comprising a piston, a barrel, and a cannon foot; the piston placed in a top of the barrel; the cannon foot comprising a rod, a top of the rod pressed against the piston; and a bottom of the rod attached to the foot; a tank of pressurized gas located inside of the vehicle, or large prop, with a hose attached from the tank to the cannon above the piston; means to propel the pressurized gas against the piston, pushing the piston down the barrel against the rod of the cannon foot, forcing the cannon foot out of the barrel against the ground, causing the cannon foot to push one side of the vehicle, or prop, with enough force to cause the vehicle or prop to flip over, depending upon an amount of pressure from the propelled pressurized gas.

2. The method of claim 1 in which the cannon is attached to an inside of the vehicle or prop.

3. The method of claim 2 in which the cannon is attached to the inside of the vehicle or prop by welding the cannon to an existing chassis or to a roll cage.

4. The method of claim 2 in which the gas tank is attached to the inside of the vehicle or prop by bolting it to a cage which is welded to a location in the vehicle or prop.

5. The method of claim 1 in which a hose is connected between the gas tank and the cannon to transfer pressurized gas from the tank to the cannon barrel.

6. The method of claim 5 in which the pressurized gas is detonated by a driver of the vehicle sending voltage which sends the pressurized gas through an air actuated ball valve releasing the pressurized gas into the cannon barrel.

7. The method of claim 1 in which placement of the cannon in the vehicle or prop determines in which direction the vehicle or prop will flip.

8. The method of claim 7 in which placement of the cannon in a rear of the vehicle or prop will cause it to flip forwards, back end leading up, if placed in a front the vehicle or prop will flip backwards, front end leading up, if placed on either side of the vehicle or prop will flip sideways to right or left sides of the vehicle or prop.

9. The method of claim 1 in which the gas is pressurized between 200 psi and 3000 psi.

10. The method of claim 1 is which the foot is circular in shape.

11. The method of claim 1 in which a stunt driver activates a gas detonation based upon all necessary elements being in proper position.

12. The method of claim 11 in which a speed and location are necessary elements.

13. A method for achieving a cinematic special effect of overturning a vehicle comprising: attaching a cannon into a vehicle; the cannon comprising a piston, a barrel, and a cannon foot; the piston placed in a top of the barrel; the cannon foot comprising a rod, a top of the rod pressed against the piston; and a bottom of the rod attached to the foot; one or more tanks of pressurized gas located inside of the vehicle, the tank or tanks being attached within the vehicle; a hose attached from the tank or tanks to the cannon above the piston; detonating the pressurized gas to power the piston down the barrel against the rod of the cannon foot, forcing the cannon foot out of the barrel against the ground, causing the cannon foot to push one side of the vehicle with enough force to cause the vehicle to flip, an amount of the flip depending upon an amount of power emanating from the propelled pressurized gas.

14. The method of claim 13 in which the gas pressure is between 200 psi and 3000 psi, depending upon the effect or a stunt.

15. The method of claim 13 in which the gas is nitrogen.

16. The method of claim 13 in which the gas is detonated through an air actuated ball valve.

17. The method of claim 13 in which the tank or tanks are hidden in the vehicle securely attached to a part of a vehicle chassis or a steel roll cage attached to the vehicle.

18. The method of claim 13 in which the cannon is configured to be securely attached anywhere within the vehicle.

19. The method of claim 18 in which placement of the cannon in the vehicle determines in which direction the vehicle will flip.

* * * * *